US006667003B2

(12) United States Patent
Schwind et al.

(10) Patent No.: US 6,667,003 B2
(45) Date of Patent: Dec. 23, 2003

(54) METHOD FOR THE MANUFACTURE OF SYNTHETIC FIBERS FROM A MELT MIXTURE BASED ON FIBER FORMING POLYMERS

(75) Inventors: Helmut Schwind, Hanau (DE); Werner Ude, Darmstadt (DE); Wolfgang Janas, Geilsebach (DE); Alexander Klein, Ingelheim (DE); Bernd Kretschmann, Alzenau (DE)

(73) Assignee: Zimmer A.G., Frankfurt am Main (DE)

( * ) Notice: Subject to any disclaimer, the term of this patent is extended or adjusted under 35 U.S.C. 154(b) by 306 days.

(21) Appl. No.: 09/852,515

(22) Filed: May 10, 2001

(65) Prior Publication Data

US 2002/0017735 A1 Feb. 14, 2002

(30) Foreign Application Priority Data

May 25, 2000 (DE) ..... 100 22 889
Mar. 27, 2001 (DE) ..... 101 15 203

(51) Int. Cl.[7] ..... C08F 20/10; C08L 33/06; D01D 5/12; D01F 6/62

(52) U.S. Cl. ..... 264/176.1; 264/210.8; 525/227; 525/241; 525/437; 526/329.7; 526/346; 526/348.1

(58) Field of Search ..... 264/176.1, 210.8; 525/227, 241, 437; 526/329.7, 346, 348.1

(56) References Cited

U.S. PATENT DOCUMENTS 5,166,238 A * 11/1992 Nakano et al. ..... 526/348.1 X

* cited by examiner

*Primary Examiner*—Leo B. Tentoni
(74) *Attorney, Agent, or Firm*—McDonnell Boehnen Hulbert & Berghoff

(57) ABSTRACT

The present invention relates to a method for the manufacture of synthetic fibers from a melt mixture of fiber forming matrix polymers, wherein at least one second amorphous additive polymer, which is immiscible with the fiber forming matrix polymer, is added to the fiber forming matrix polymers in a quantity of 0.05–5 wt % (with reference to the total weight of fiber forming matrix polymer and the additive copolymer). The additive polymer is obtained by multiple initiation. Furthermore, the present invention also relates to the synthetic fibers produced by the method.

11 Claims, No Drawings

METHOD FOR THE MANUFACTURE OF SYNTHETIC FIBERS FROM A MELT MIXTURE BASED ON FIBER FORMING POLYMERS

BACKGROUND OF THE INVENTION

1. Field of the Invention

The present invention relates to a method for the manufacture of synthetic filaments from a mixture of fiber forming polymers. The filaments can be used as endless filaments or they can be further processed to staple fibers.

2. Summary of the Related Art

Spinning of polymer mixtures to form synthetic filaments is known. The purpose of using an additive polymer to form a mixture is to achieve, at a given spinning speed, a higher elongation at break of the spun filament. This permits a higher stretch ratio for the manufacture of the final yarn, which, in turn, results in a higher productivity of the spinning unit.

Increased production leads to improved profitability for the manufacturing process. Productivity is reduced to a certain extent by production difficulties and more expensive high-speed installations. The additional costs for the additive polymer can be considerable so, depending on the quantity added, zero profitability can result. The market availability of the additive polymer also plays an important role. Many of the additives described in the literature are commercially unfeasible for large-scale industrial conversion.

Producers or process operators must take into account the entire production chain and cannot limit themselves to increasing the production of a single step (for example, the spinning process), only. The subsequent processes must not be negatively impacted. In particular it is a main objective of the present invention not to negatively impact the subsequent processes, preferably to improve said subsequent processes despite of an increased spinning speed.

In the manufacture of POYs (partially oriented yarns), very high elongations at break for polymer mixtures have been achieved (even at high spinning speeds) and is characterized by a strong reduction in the degree of orientation. Such spun filaments are known to be unstable during storage and cannot be applied and processed in stretch texturing at high speeds. Elongations at break of <70% (indicated for high spinning speeds) in turn means a considerable degree of crystallization, which reduces the strength that can be achieved in the texturing process.

The first proposed solutions for these problems were disclosed in the Patents EP 0 047 464 B (Teijin), DE 197 07 447 (Zimmer), DE 199 37 727 (Zimmer), DE 199 37 728 (Zimmer) and WO 99/07 927 (Degussa). EP 0 047 464 B concerns an unstretched polymer yarn, where, as a result of the addition of 0.2–10 wt % of a polymer of the type $—(—CH_2—CR^1R^2—)_n—$ (e.g., poly(4-methyl-1-pentene) or polymethyl methacrylate), improved productivity and higher stretch ratios are achieved as a result of the increase in the elongation at break of the spun filament at speeds of 2500–8000 m/min. It is necessary to achieve a fine and homogeneous dispersion of the additive polymer by mixing, where a particle diameter $\leqq 1$ $\mu$m avoids fibril formation. The effect arises from the combined action of three properties—chemical additive structure, which allows almost no elongation of the additive molecule, low mobility, and the compatibility between polyester and additive. These factors serve to increase productivity. No requirements for the stretch texturing are disclosed. Carrying out the method disclosed in WO 99/07927 leads to a high comsumption of additive polymer and an impairment of the quality and the subsequent processability of the resulting fibers.

DE 197 07 447 (Zimmer) concerns the manufacture of polyester or polyamide filaments with an elongation at break of $\leqq 180\%$. The addition of 0.05–5 wt % of a copolymer made of 0–90 wt % (meth)acrylic acid alkyl ester, 0–40 wt % maleic acid (anhydride), and 5–85 wt % styrene to the polyester or polyamide allows a clear increase in the spinning draw-off speed.

Patent DE 199 37 727 (Zimmer) discloses the manufacture of polyester staple fibers from a polymer mixture, which mixture contains 0.1–2.0 wt % of an immiscible, amorphous, additive polymer having a glass transition temperature of 90–170° C. The ratio of the additive polymer melt viscosity to the melt viscosity of the polyester component is indicated to be from 1:1 to 10:1.

DE 199 37 728 (Zimmer) relates to a method for the manufacture of HMLS fibers made of polyester, additive polymer, and optionally additives with a spinning draw-off speed of 2500–4000 m/min. The additive polymer is reported to have a glass transition temperature of 90–170° C., and the ratio of the melt viscosity of the additive polymer to the melt viscosity of the polyester component is reported to be from 1:1 to 7:1.

WO 99/07927 relates to the manufacture of POYs by spinning polymer mixtures based on polyester at a draw-off speed $\nu$ of at least 2500 m/min, where a second, amorphous, thermoplastically processible copolymer is added to the polyester and has a glass transition temperature of more than 100° C. The ratio of the melt viscosity of the copolymer to the melt viscosity of the polyester is reported to be from 1:1 to 10:1. At least 0.05 wt % of copolymer is added to the polyester, and the quantity M of the copolymer added to the polyester is dependent on the draw-off speed $\nu$ and is $$M = \left[\frac{1}{1600} \cdot \nu\left(\frac{m}{\min}\right) - 0.8\right][\text{wt}\,\%]$$

Although the foregoing methods result in very good filament rupture rates that are suitable for practical use, industrial use nevertheless requires methods for spinning polymer mixtures with even lower number of filament ruptures to further increase the efficiency of the spinning method. Furthermore, the behavior of the synthetic filaments during subsequent processing, particularly during stretch texturing, should be improved.

In the foregoing methods, the additive polymer agents for increasing elongation are usually granulated in order to increase their flowability before addition by metering to the polyester. However, due to large particle size, the granulated additive polymer is relatively difficult to add, and the metering is not consistent. This leads to a worsening of the yarn characteristics, e.g., dye uptake behavior and particularly the homogeneity of the synthetic fibers.

SUMMARY OF THE INVENTION

We recognized that granulating the elongation increasing agent is time and cost intensive, and, therefore, methods for the melt spinning of polymer mixtures using non-granulated elongation increasing agents would be desirable. We report here that the elongation increasing agents can be added evenly and continuously by metering without granulating.

As described below, this is accomplished according to the present invention by employing amorphous additive polymers obtained by multiple initiation. We have unexpectedly found that use of such amorphous additive polymers significantly lessens the residual monomer content of the synthetic fibers produced, thereby obviating the need to granulate the additive polymers as practiced in the art.

The present invention comprises a simple method for the manufacture of synthetic filaments from a mixture of fiber forming matrix polymers that allows the manufacture of synthetic fibers with a lower fiber rupture rate. In particular, the method of manufacture yields POYs having values of elongation at break of 90–165%, high consistency with regard to the filament characteristics, and a low degree of crystallinity.

The present invention also comprises a method for the manufacture of synthetic fibers from a mixture of fiber forming matrix polymers that allows the use of non-granulated elongation increasing agents and thus is considerably more cost effective than methods known in the state of the art.

The present invention also comprises a method for spinning synthetic filaments that can be carried out on a large industrial scale in a cost effective manner. In particular, the method of the invention allows the manufacture of POYs with very high draw-off speeds, preferably ≧2500 m/min.

The method of the invention does not negatively impact subsequent processing; rather it improves it despite the increased spinning speed.

According to the invention, the synthetic fibers lend themselves to further processing in a simple manner. In particular, the POYs obtained according to the invention allow further processing in a stretching process or a stretch texturing process, preferably at high processing speeds and with a small number of filament ruptures.

The present method comprises the manufacture of synthetic fibers from a melt mixture of fiber forming matrix polymers, wherein one adds to the fiber forming polymer matrix 0.05–5 wt % (with reference to the total weight of the fiber forming matrix polymer) at least one second amorphous additive polymer that is immiscible with the fiber forming matrix polymer and that is synthesized by multiple initiation. This method unexpectedly yields synthetic fibers with a low filament rupture rate. Furthermore, the method according to the invention does not require granulation of the additive polymer elongation increasing agent.

At the same time, the method according to the invention permits formation of a good spool arrangement in a simple manner that allows homogeneous and nearly error free dying and further processing of the synthetic fiber due to the high homogeneity of the synthetic fiber produced by the method. The synthetic fibers produced by the method of the invention can be further processed in a simple manner, on a large industrial scale, and cost effectively. For example, the POYs according to the invention can be stretched or stretch textured at high speeds with a small number of filament ruptures. The method according to the invention is particularly well suited for the manufacture of POYs having elongation at break values of 90–165%, a high homogeneity with respect to the filament characteristics, as well as a low degree of crystallization.

DETAILED DESCRIPTION OF THE INVENTION

The method of the present invention concerns the manufacture of synthetic fibers from a melt mixture of fiber forming matrix polymers.

Spinning according to the invention can occur by means of a direct spinning method, in which the elongation increasing agent is added as a melt by metering to the melt of the matrix polymers, or by an extrusion spinning method, in which the elongation increasing agent is added as a solid substance to the matrix polymer and melted thereafter. Additional details concerning suitable spinning methods can be obtained from the literature, for example, from the Patents EP 0 047 464 B, WO 99/07 927, DE 100 22 889 and DE 100 49 617, whose disclosures are incorporated by reference.

In the context of the present invention, synthetic fibers denote all types of fibers that can be obtained by spinning mixtures of synthetic, thermoplastic polymers. They include, among other fibers, staple fibers (spinning fibers) and textile filaments, such as smooth yarns, POYs, FOYs, and industrial filaments.

Further details concerning synthetic fibers, particularly with reference to their material properties and the usual manufacturing conditions, can be obtained from the literature, for example, from Fourné "Synthetische Fasern: Herstellung, Maschinen und Apparate, Eigenschaften; Handbuch für Anlagenplanung, Maschinenkonstruktion und Betrieb [Synthetic Fibers: Manufacture, Machines and Apparatuses, Properties; Handbook for Installation Planning, Machine Construction and Operation]," Munich, Vienna; Hanser Verlag 1995, as well as from the Patents DE 199 37 727 (staple fibers), DE 199 37 728 and DE 199 37 729 (industrial yarns) and WO 99/07 927 (POYs). The disclosures of these publications are incorporated by reference.

The method of the present invention is well suited for the manufacture of staple fibers, smooth fibers, POYs, FOYs or industrial filament. We have found the method to be particularly well suited for the manufacture of POYs.

According to the invention, it is possible to use thermoplastically processible polymers, preferably polyamides, such as polyamide-6 and polyamide-6,6, and polyester as the fiber forming matrix polymers. It is also possible to use mixtures of different polymers. Preferably, the polymers manufactured according to the method of the invention are polyesters, particularly polyethylene terephthalate (PET), polyethylene naphthalate, polytrimethylene terephthalate (PTMT) and polybutyelene terephthalate (PBT). In a particularly preferred embodiment of the present invention, the matrix polymer is polyethylene terephthalate, polytrimethylene terephthalate or polybutylene terephthalate (most preferably polyethylene terephthalate).

Preferably, the method of the invention employs homopolymers as the fiber forming matrix polymers. However, copolymers can also be used, preferably polyester copolymers containing up to 15 mol % of conventional co-monomers, such as, for example, diethylene glycol, triethylene glycol, 1,4-cyclohexane dimethanol, polyethylene glycol, isophthalic acid and/or adipic acid.

The polymers according to the invention can contain as additional components additives that are conventionally used for thermoplastic mold compositions and that contribute to improving the polymer properties. Examples of such additives are: antistatics, antioxidants, fire inhibitors, lubricants, dyes, light stabilizers, polymerization catalysts and polymerization promoting agents, adhesives, matting agents and/or organic phosphites. These additives can be used in the usual quantity employed fiber manufacturing, preferably in quantities of up to 10 wt %, advantageously <1 wt %, with reference to 100 wt % of the polymer mixture.

If a polyester is used in the method according to the invention, it can also contain a small proportion (maximum 0.5 wt %) of branching components, e.g., polyfunctional acids such as trimellitic acid, pyromellitic acid, or tri- to hexa-valent alcohols, such as trimethylolpropane, pentaerythritol, dipentaerythritol, glycerol, or corresponding hydroxy acids.

According to the invention, one adds to the matrix polymer an additive polymer in a quantity of at least 0.05 wt %, where the additive polymer is amorphous and largely insoluble in the matrix polymer. Essentially the two polymers must be immiscible, and they must form two phases that can be distinguished microscopically. Furthermore, the additive polymer must have a glass transition temperature of more than 100° C. (determinable by DSC using a heating rate of 10° C./min) and must be thermoplastically processible. The melt viscosity of the additive polymer should be such that the ratio of its melt viscosity to that of the matrix polymer is equal to or greater than 1, preferably between 1:1 and 10:1, more preferably between 1.4:1 and 8:1, and even more preferably between 1.7:1 and 6.5:1. Under these conditions, the mean particle size of the additive polymer is 140–350 nm. The melt viscosities are extrapolated to measurement time zero and measured at an oscillation rate of 2.4 Hz and a temperature equal to the melting temperature of the matrix polymer plus 34.0° C. (in the case of polyethylene terephthalate, 290° C.).

The quantity of the additive polymer to be added to the matrix polymer is 0.05–5 wt % (with reference to the total weight of the polymer mixture). For many applications, such as the manufacture of POYs, it is sufficient to use additive polymer in amounts of less than 1.5 wt % (frequently <1.0 wt %) at draw-off speeds of more than 3500 m/min (and up to 6000 m/min and higher), which results in considerable cost savings.

The mixing of the additive polymer with the matrix polymer can be conducted in manner known to those skilled in the art. It is described, for example, in WO 99/07 927 and DE 100 22 889, whose disclosure is incorporated by reference.

The spinning of the polymer mixture occurs at temperatures in the range of 220–320° C., depending on the matrix polymer.

A variety of chemically distinct additive polymers can be employed in the method of the invention. Additive polymers that are particularly suitable for use in the method of the invention include, but are not limited to, the polymers and/or copolymers listed below:

1. A polymer prepared by the polymerization of monomers having the general formula I:

I

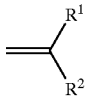

where $R^1$ and $R^2$ are substituents consisting of the optional atom C, H, O, S, P and halogen atoms, and the sum of the molecular weight of $R^1$ and $R^2$ is at least 40. Examples of monomer units include acrylic acid, methacrylic acid, styrene and $C_{1-3}$ alkyl substituted styrenes, and $CH_2{=}CR{-}COOR'$, where R is —H or —$CH_3$, and R' is $C_{1-15}$ alkyl, $C_{5-12}$ cycloalkyl, or $C_{6-14}$ aryl residue.

2. A copolymer of monomer units A and B, wherein,

A=acrylic acid, methacrylic acid or $CH_2{=}CR{-}COOR'$, where R is —H or —$CH_3$, and R' is $C_{1-15}$ alkyl, $C_{5-12}$ alkyl residue, or $C_{6-14}$ aryl, B=styrene or $C_{1-3}$ alkyl substituted styrenes, and wherein the copolymer consists of 60–98 wt % A and 2–40 wt % B, preferably 83–98 wt % A and 2–17 wt % B, and more preferably 90–98 wt % A and 2–10 wt % B (total=100 wt %).

3. A copolymer of monomer units C and D, wherein,

C=styrene or $C_{1-3}$ alkyl substituted styrenes,

D=one or more monomers having formula II, III, or IV

II

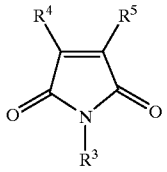

III

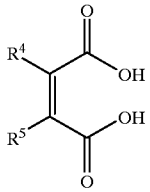

IV

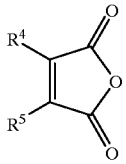

wherein $R^3$, $R^4$ and $R^5$ are independently H, $C_{1-15}$ alkyl, $C_{6-14}$ aryl, or $C_{5-12}$ cycloalkyl, and where the copolymer consists of 15–95 wt % C and 2–80 wt % D, preferably of 50–90 wt % C and 10–50 wt % D, and most preferably 70–85 wt % C and 15–30 wt % D, and where the total of C and D is 100 wt %.

4. A copolymer of monomer units E, F, G, and H, wherein

E=acrylic acid, methacrylic acid, or $CH_2{=}CR{-}COOR'$, where R is —H or —$CH_3$, and R' is $C_{1-15}$ alkyl, $C_{5-12}$ cycloalkyl, or $C_{6-14}$ aryl, F=styrene or $C_{1-3}$ alkyl substituted styrene, G=one or more monomers having formula II, III, or IV (shown above), H=one or more ethylenically unsaturated monomers (which are optionally co-polymerized with E, F, and/or G) selected from the group consisting of α-methylstyrene, vinyl acetate, acrylic acid esters and methacrylic acid esters differing from E, acrylonitrile, acrylamide, methacrylamide, vinyl chloride, vinylidene chloride, halogen substituted styrenes, vinyl ethers, isopropylene ethers, and dienes, wherein the copolymer consists of 30–99 wt % E, 0–50 wt % F, 0–50 wt % G and 0–50 wt % H, preferably 45–97 wt % E, 0–30 wt % F, 3–40 wt % G and 0–30 wt % H, and more preferably 60–94 wt % E, 0–20 wt % F, 6–30 wt % G and 0–20 wt % H, where the total of E, F, G and H is 100 wt %.

Component H is an optional component. Although the advantages provided by the method of the invention are achievable using copolymers of E–G, the advantages are also obtained when copolymers are formed with the monomers from group H.

Preferably, component H is chosen in such a manner that it has no disadvantageous effect on the properties of the copolymers.

Some of the purposes for which component H can be used include: (a) to modify the properties of the copolymer in the desired manner, for example, by increasing or improving the flow properties when the copolymer is heated to the melting temperature, (b) to reduce residual dye in the copolymer, and (c) to introduce a certain degree of crosslinking into the copolymer by using a poly-functional monomer.

Moreover, H can also be chosen in such a manner that copolymerization of components E–G occurs or is promoted only in the presence of H. For example MSA and MMA by themselves do not copolymerize, although they undergo copolymerization if a third component, such as styrene, is added.

"H" monomers that are suitable for this purpose include vinyl ester, esters of acrylic acid (e.g., methyl acrylate and ethyl acrylate), esters of methacrylic acid (different from methyl methacrylate) (e.g., butyl methacrylate and ethyl hexyl methacrylate), acrylonitrile, acrylamide, methacrylamide, vinyl chloride, vinylidene chloride, styrene, α-methylstyrene, and the various halogen substituted styrenes, vinyl- and isopropenyl ethers, dienes (e.g., 1,3-butadiene and divinylbenzene). Color reduction of the polymers can be achieved, for example, in a particularly preferred manner by using an electron rich monomer, such as vinyl ether, vinyl acetate, styrene or α-methylstyrene.

Among the compounds of H, use of aromatic vinyl monomers, such as styrene or α-methylstyrene, are particularly preferred.

Manufacture of the additive polymers to be used according to the invention is known and any such method can be employed. The additive polymers can be manufactured by substance, solution, suspension or emulsion polymerization. Useful teachings of substance polymerization can be found in Houben-Weyl, Volume E20, Part 2 (1987), pp. 1145 ff. Teachings of solution polymerization can be found in the same volume on pages 1156 ff. In the same volume, the suspension polymerization technique is described on pages 1149 ff, while the emulsion polymerization is described and explained in the same volume on pages 1150 ff.

It is particularly preferred to use bead polymers whose particle size is in a particularly advantageous range. It is particularly preferred that the additive polymers to be used, for example, by mixing in the melt of fiber polymers, are in the form of particles having a mean particle size of 0.1–1.0 mm. However, larger or smaller beads can also be used.

All the copolymers according to the invention, are commercially available or can be manufactured by methods routine to those skilled in the art.

For polymer mixtures made of polyethylene terephthalate for textile applications, such as POYs with a limit viscosity value of approximately 0.55–0.75 dL/g and additive polymers of type 1, 2, 3 or 4, additive polymers with viscosity values of 70–130 $cm^3/g$ are preferred.

In one embodiment of the method of the invention, an additive polymer obtained by multiple initiation is added. The term "multiple initiation" includes both single and multiple post-initiation of a radical-induced polymerization, i.e., it includes single or multiple renewed addition of initiator at later reaction times as well as radical induced polymerization in the presence of a mixture comprising at least two initiators with different half lives (which are particularly preferred in the context of the present invention). For the purposes of the invention, half lives of initiators are considered different when they possess different half lives at the same temperature or the same half life at different temperatures. It is preferred to use initiators with a half life of one hour in temperature ranges that are separated by at least 10° C. It is possible to use a single compound as initiator for a single temperature. It is also possible to use two or more initiators, each with an appropriate half life for a particular temperature range.

Such polymerizations are described, for example, in the U.S. Pat. No. 4,588,798, U.S. Pat. No. 4,605,717, EP 489 318, DE 199 17 987, and the documents cited therein. The disclosures of these patents is incorporated herein by reference.

In the context of the present invention it has been found to be particularly advantageous to use an initiator mixture that uses an initiator $I_1$ with a half life $T_1$ of one hour in the range 70–85° C., and an additional initiator $I_2$ with a half life $T_2$ of one hour in the range 85–100° C. Other initiators $I_n$ that can optionally be used preferably have degradation temperatures $T_n$ between $T_1$ and $T_2$.

The quantity of the initiator mixture to be used can be varied within relatively broad ranges. Varying the amount of initiator facilitates control of the polymerization time and influences the polymerization temperature. The quantities of initators used according to the invention are given in parts by weight of initiator per 100 parts by weight of monomer. It is advantageous to use a total quantity of initiator mixture of approximately 0.05–1.0 parts by weight per 100 parts by weight of monomer, preferably 0.05–0.5 part by weight, and, most preferably, 0.15–0.4 part by weight per 100 parts by weight of monomer.

The ratio by weight of the individual initiators to each other in the initiator mixture can also be varied within relatively broad ranges. It is preferred to use a ratio by weight of the individual initiators to each other in the range from 1:1 to 1:10, preferably 1:1 to 1:4. Suitable quantities and mixing ratios can be easily and routinely determined with simple preliminary tests.

Suitable initiators that can be used to synthesize additive polymers for use in the invention include conventional initiators that are used for radical formation in radical initiated polymerizations. They include compounds such as organic peroxides (e.g., dicumyl peroxide), diacyl peroxides (e.g., dilauroyl peroxide), peroxydicarbonates (e.g., diisopropyl peroxydicarbonate), peresters (e.g., tert-butylperoxy-2-ethylhexanoate), and similar compounds. Other compound types that are capable of forming radicals are also suitable for use in the present invention. In particular, such compounds include azo compounds such as 2,2'-azobisisobutyronitrile and 2,2'-azobis(2,4-dimethylvaleronitrile).

It has been found that mixtures whose components are chosen from the following initiators are particularly advantageous (the indicated temperatures are those at which the half life of the corresponding initiator is 1 hour):

tert-amylperoxy pivalate, 71° C.,
2,2'-azobis-(2,4-dimethylvaloernitrile), 71° C.,
di-(2,4-dichlorobenzoyl) peroxide, 72° C.,
tert-butylperoxy pivalate, 74° C.,
2,2'-azobis-(2-amidinopropane) dihydrochloride, 74° C.,
di-(3,5,5-trimethylhexanoyl) peroxide, 78° C.,
dioctanoyl peroxide, 79° C.,
dilauroyl peroxide, 80° C.,
didecanoyl peroxide, 80° C.,
2,2'-azobis-(N,N'-dimethylene isobutyramidine), 80° C.,
di-(2-methylbenzoyl) peroxide, 81° C.,
2,2'-azobisisobutyronitrile, 82° C.,
2,2'-dimethylazobisisobutyrate, 83° C.,
2,2'-azobis-(2-methylbutyronitrile), 84° C., 2,5-dimethyl-2,5-di-(2-ethylheanoylperoxy) hexane, 84° C., 4,4'-azobis-(cyanopentanoic acid), 86° C., di-(4-methylbenzoyl) peroxide, 89° C., dibenzoyl peroxide, 91° C., tert-amylperoxy-2-ethylhexanoate, 91° C., tert-butylperoxy-2-ethylhexanoate, 92° C., tert-butylperoxy isobutyrate, 96° C.

Peroxide initiators are particularly preferred.

Polymerization of additive polymers can be carried out under substantially isothermal conditions partly or over broad ranges. In a particularly preferred embodiment of the present invention, polymerization is carried out in at least two steps. In the first step, polymerization is carried out first at a lower temperature, preferably 60 to less than 85° C. In the second step, polymerization is carried out at a higher temperature, preferably at 85–120° C.

It is preferred that the additive polymer has a residual monomer content of less than 0.62 wt %, more preferably less than 0.47 wt %, and even more preferably less than 0.42 wt %, in each case with reference to the total weight of the additive polymer. In a particularly preferred embodiment, the residual monomer content of the additive polymer is less than 0.37 wt %, more preferably less than 0.30 wt %, even more preferably less than 0.25 wt %, and yet even more preferably less than 0.20 wt %, in each case with reference to the total weight of the additive polymer.

The residual monomer content in the additive polymer refers to the quantity of monomer that remains after polymerization and separation of the additive polymer. In the case of polymers manufactured by radical induced polymerization, the residual monomer content is usually in the range of 0.65–1.0 wt % with reference to the total weight of the polymer. Methods for the reduction of the residual monomer content of a polymer are known to those skilled in the art. For example, monomer content can be reduced by degassing polymer melts, preferably in the extruder, directly before the spinning. In addition, it is also possible to obtain polymers with a reduced residual monomer content by a suitable choice of the polymerization parameters.

Moreover, it is extremely advantageous to admix a flowability promoting agent with the additive polymer. The term flowability promoting agents here refers to all process agents that are admixed in small quantities, in powdered or granulated form (particularly hygroscopic substances), in order to prevent clumping or caking together, and thus to guarantee free flow. Flowability promoting adjuvants (also called anti-adhesive agents, anti-caking agents, or fluidizers) useful in the present invention include water insoluble, hydrophobicity producing, or humidity adsorbing powders such as diatomaceous earth, pyrogenic salicylic acids, tricalcium phosphate, calcium silicates, $Al_2O_3$, MgO, $MgCO_3$, ZnO, stearates, and fatty amines (see CD Römpp Chemie Lexikon [Römpp Chemistry Lexicon]—Version 1.0, Stuttgart/New York: Georg Thieme Verlag, 1995).

Such flowability promoting adjuvants have been shown to be suitable only under certain conditions, however, because they can be detrimental to the spinning process. They can become deposited in the spinning device and lead to clogging of the lines and nozzles and, thus, to operational disfunctions. There is also the risk that as a result of the "extraneous substances," the material properties of the resulting synthetic fibers are worsened, and the filament rupture rate during spinning increased.

Therefore, according to the invention, polymers and/or copolymers are particularly preferred as flowability promoting agents as they do not introduce the same deleterious consequences as the aforementioned agents. The polymers and/or copolymers listed below have been found to be particularly advantageous:

1. A polymer prepared by the polymerization of monomers having the general formula (I):

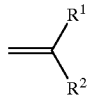

where $R^1$ and $R^2$ are substituents consisting of the optional atom C, H, O, S, P and halogen atoms, and the sum of the molecular weight of $R^1$ and $R^2$ is at least 40. Examples of monomer units include acrylic acid, methacrylic acid, styrene, $C_{1-3}$ alkyl substituted styrenes, and $CH_2{=}CR{-}COOR'$, where R is —H or $=CH_3$, and R' is $C_{1-15}$ alkyl, $C_{5-12}$ alkyl, or $C_{6-14}$ aryl.

2. A copolymer containing the following monomer units:

A=acrylic acid, methacrylic acid or $CH_2{=}CR{-}COOR'$, where R is —H or $-CH_3$, and R' is $C_{1-15}$ alkyl, $C_{5-12}$ cycloalkyl, or $C_{6-14}$ aryl, B=styrene or $C_{1-13}$ alkyl substituted styrenes, where the copolymer consists of 60–98 wt % A and 2–40 wt % B, preferably 83–98 wt % A and 2–17 wt % B, and more preferably 90–98 wt % A and 2–10 wt % B (total=100 wt %).

3. A copolymer containing the following monomer units:

C=styrene or $C_{1-3}$ alkyl substituted styrenes,

D=one or more monomers having formula II, III, or IV (above)

where the copolymer consists of 15–95 wt % C and 2–80 wt % D, preferably 50–90 wt % C and 10–50 wt % D, and more preferably 70–85 wt % C and 15–30 wt % D, where the total of C and D is 100 wt %.

4. A copolymer containing the following monomer units:

E=acrylic acid, methacrylic acid, or $CH_2{=}CR{-}COOR'$, where R is —H atom or $-CH_3$, and R' is $C_{1-15}$ alkyl, $C_{5-12}$ cycloalkyl, or $C_{6-14}$ aryl, F=styrene or $C_{1-3}$ alkyl substituted styrene, G=one or more monomers having formula II, III or IV (above), H=one or more ethylenically unsaturated monomers, which can be copolymerized with E, F, and/or G, selected from the group consisting of α-methylstyrene, vinyl acetate, acrylic acid esters and methacrylic acid esters differing from E, acrylonitrile, acrylamide, methacrylamide, vinyl chloride, vinylidene chloride, halogen substituted styrenes, vinyl ethers, isopropylene ethers, and dienes, where the copolymer consists of 30–99 wt % E, 0–50 wt % F, 0–50 wt % G and 0–50 wt % H, preferably 45–97 wt % E, 0–30 wt % F, 3–40 wt % G and 0–30 wt % H, and more preferably 60–94 wt % E, 0–20 wt % F, 6–30 wt % G and 0–20 wt % H, where the total of E, F,G and H is 100 wt %.

Component H is an optional component. Although the advantages that can be achieved according to the invention can be achieved by using copolymers, which comprise components from the groups E–G, the advantages achievable according to the invention are also obtainable if other monomers from group H are included in the copolymers.

Component H is preferably chosen in such a manner that it has no disadvantageous effect on the properties of the copolymers to be used according to the invention.

Some of the purposes for which component H can be used include: to modify the properties of the copolymer in the desired manner, e.g., by increasing or improving the flow properties when the copolymer is heated to the melting temperature, to reduce residual dye in the copolymer, or to introduce, by using a polyfunctional monomer, a certain degree of crosslinking into the copolymer.

Moreover, H can also be chosen in such a manner that copolymerization of components E–G occurs or is promoted only in the presence of H. For example MSA and MMA by themselves do not copolymerize although they undergo copolymerization if a third component, such as styrene, is added.

Monomers that are suitable for this purpose include vinyl ester, esters of acrylic acid (e.g., methyl acrylate and ethyl acrylate), esters of methacrylic acid (which differ from methyl methacrylate) (e.g., butyl methacrylate and ethyl hexyl methacrylate), acrylonitrile, acrylamide, methacrylamide, vinyl chloride, vinylidene chloride, styrene, α-methylstyrene, and the various halogen substituted styrenes, vinyl- and isopropenyl ethers, dienes (e.g., 1,3-butadiene), and divinylbenzene. Color reduction of the polymers can be achieved in a particularly preferred manner, for example, by using an electron rich monomer such as vinyl ether, vinyl acetate, styrene or α-methylstyrene.

It is particularly preferred to use, among the compounds of component H, aromatic vinyl monomers, such as, for example, styrene or α-methylstyrene.

Methods of manufacturing the aforementioned flowability promoting agents is known to those skilled in the art. They can be manufactured by substance, solution, suspension or emulsion polymerization. Useful teaching on substance polymerization can be found in Houben-Weyl, Volume E20, Part 2 (1987), pages 1145 ff. Teachings concerning the solution polymerization can be found in the same volume on pages 1156 ff. The suspension polymerization technique is described in the same volume on pages 1149 ff, while the emulsion polymerization is described and explained in the same volume on pages 1150 ff. Optionally, the polymers can be additionally milled.

It is particularly preferred to use flowability promoting agents whose particle size is in a particularly advantageous range. It is particularly preferred for the flowability promoting agents to be in the form of particles having a mean diameter of 0.01 to less than 100 μm. However, flowability promoting agents with larger or smaller particle sizes can also be used.

Imidized copolymer of types 3 and 4, above, can be manufactured from monomer maleinimides and also by the subsequent complete or, preferably, partial imidization of a copolymer containing the corresponding maleic acid derivative. These flowability promoting agents are manufactured, for example, by complete, or, preferably, partial conversion of the corresponding copolymer in the melt phase with ammonia or with a primary alkylamine or arylamine, e.g., aniline (Encyclopedia of Polymer Science and Engineering, Vol. 16 (1989), Wiley-Verlag, page 78). The resulting copolymers optionally can be additionally milled.

All the copolymers according to the invention as well as their non-imidized starting polymers, to the extent indicated, are commercially available or they can be manufactured by routine methods by those skilled in the art.

In the context of the present invention, flowability promoting agents that have substantially the same chemical composition as the additive polymer used have been shown to be particularly advantageous. The flowability promoting agents and the additive polymer used advantageously contain at least 50 wt %, preferably at least 60 wt %, more preferably at least 70 wt %, and even more preferably at least 80 wt % (in each case with reference to the total weight of the flowability promoting agents or of the additive polymer used) of the same repeating monomer units.

Particularly advantageous results according to the invention are achieved if the flowability promoting agents and the additive polymer used comprise at least 90 wt %, preferably at least 95 wt %, and more preferably at least 97 wt % of the same repeating units, in each case with reference to the total weight of the flowability promoting agent or the additive polymer used. In a particularly preferred embodiment of the present invention the polymer composition of the flowability promoting agent and that of the additive polymer used are comprised of the same repeating monomer units.

In the context of the present invention it is advantageous to use a flowability promoting agent that has a weight average molecular weight that is similar to that of the additive polymer used. Advantageously, the weight average molecular weight of the flowability promoting adjuvant differs by less than 50%, preferably by less than 30%, and more preferably by less than 20% from that of the additive polymer used.

The preferred concentration range of the flowability promoting adjuvant in additive polymer is 0.05–5.0 wt %, preferably 0.05–1.0 wt %, in each case with respect to the total weight of additive polymer and flowability promoting adjuvant, and depends on the surface (and thus the mean diameter) of the additive polymers. In the case of a bead polymer having a mean particle size of 0.7 mm, it is preferred to use a concentration of the flowability promoting agent of 0.05–0.3 wt %. With decreasing diameter of the beads the required concentration of flowability promoting adjuvant to achieve the flow promoting effect increases. If the concentration of the flowability promoting adjuvant is too low, the flow promoting effect is incomplete. By contrast, if the concentrations of the flowability promoting agents are too high, no additional improvement in the flow behavior is achieved, although a strong, industrially undesirable, dust formation occurs due to the excess, finely divided flowability promoting adjuvant powder.

It is more advantageous to manufacture the flowability promoting adjuvant by an emulsion polymerization method, followed by isolation by spray drying. The spray drying can be carried out in a known manner. Examples of descriptions of spray drying can be found in DE 332 067 or in Ullmann's Encyclopedia of Industrial Chemistry, $5^{th}$ edition (1988), B 2, pp. 4–23. Depending on the spray aggregate (single substance nozzle, two substance nozzle or atomization disk), particles having a mean particle diameter of 20–300 μm are obtained.

The mixture of additive polymer and flowability promoting adjuvant to form an elongation increasing agent (which is preferably homogenous as possible) can be carried out in a manner known to those skilled in the art. Details can be found, for example, in Ullmanns Enzyklopädie der technischen Chemie, $5^{th}$ edition (1988), as well as in Römpps Chemie Lexikon (CD)—Version 1.0, Stuttgart/New York: Georg Thieme Verlag, 1995.

It has been found to be very advantageous to mix the additive polymer, which is preferably dried using a fluidized bed dryer, and the spray dried flowability promoting adjuvant using a fluidized bed dryer. Details on the fluidized bed process can be found in the specialty literature, e.g., in Ullmanns Encyclopedia of Industrial Chemister, $5^{th}$ edition (1988), as well as in Römpps Chemie Lexikon (CD)—Version 1.0, Stuttgart/New York: Georg Thieme Verlag, 1995.

The elongation increasing agent to be used in the invention is not granulated, in contrast to the state of the art. In this context, the term granulation refers to the manufacture of so-called pellets (granulates) having the same shape and size. The polymer to be granulated is usually melted in a one- or double worm extruder and introduced into a pelletization machine. Comminution can be carried out by cold pelletization or hot pelletization. In cold pelletization, strands, strips or thin films are manufactured by the granulation nozzle, which are then comminuted after solidification by means of rotating knives. In hot pelletization, the plasticized polymer is pressed through the nozzle and the exiting strand is comminuted by means of a rotating knife, which is usually attached to the nozzle plate. The cooling of the melt occurs after the pelletization, usually either with air or water.

The manufacture of the synthetic fibers from polymer mixtures according to the invention by melt spinning can be carried out using art recognized spinning installations, as described, for example, in the Patents DE 199 37 727 (staple fibers), DE 199 37 728 and DE 199 37 729 (industrial yarns) and WO 99/07 927 (POYs), the disclosures of which are incorporated herein by reference.

Since the methods according to the invention have been shown to be particularly advantageous for the manufacture of POYs, its manufacture is describe below. The application of the method for the manufacture of other synthetic fibers will be immediately obvious to a person skilled in the art.

Preferably, the melt spinning of POYs is carried out at spinning draw-off speeds of at least 2500 m/min. The filter unit can be fitted with filtering devices and/or loose filter media (for example, steel sand) in an art recognized manner.

After completion of the shearing and filtration treatment, the molten polymer mixture is pressed in the nozzle unit through the boreholes of the nozzle plate. In the cooling zone that follows, the melt filaments are cooled by means of cooling air to a temperature below their softening temperature to avoid adhesion or jamming to the following filament guide organ. The form of the cooling zone is not critical, provided a homogeneous stream of air that evenly passes through the filament bundle is maintained. Thus, an air rest zone can be provided immediately under the nozzle plate to delay the cooling. The cooling air can be supplied by means of diagonal or radial ventilation from an air conditioner system, or by means of a cooling pipe from the environment with unaided suction.

After cooling, the filaments are bundled and spinning oil is applied. To achieve this, oiling stones are supplied with the spinning oil by metering pumps in the form of an emulsion. The prepared yarns advantageously run through an entangling device to improve the filament closure. It is also possible for handling and safety devices to be provided before the filament reaches the winding unit, where it is spooled onto cylindrical spool bodies to form packets. The circumferential speed of the filament packet is automatically regulated and is equal to the spooling speed. The draw-off speed of the filament can be 0.2–2.5% higher than the spooling speed due to its changing orientation. Optionally, driven rollers can be used after preparation or before spooling. The circumferential speed of the first roller system is called the draw-off speed. Additional rollers can be used for stretching or relaxing.

Due to the immiscibility of the matrix polymer and additive polymer, immediately after the exit of the polymer mixture from the spinning nozzle the additive polymer forms ball-like or longitudinally shaped particles in the matrix polymer. Advantageously, the length/diameter ratio of the particles is >2. The best conditions were found to correspond to those in which the mean particle size (arithmetic mean) $d_{50} \leqq 400$ nm and the fraction of particles >1000 nm in sample cross section was less than 1%.

It was possible to analytically show how these particles were influenced by the spinning traction. Examination of the spinning filaments by TEM [transmission electron microscopy] has shown that the structure was fibril like. The mean diameter of the fibrils was estimated to be approximately 40 nm. The length/diameter ratio of the fibrils was >50. If these fibrils are not formed, if the additive particles exiting from the spinning nozzle have too large a diameter, or if the particle size distribution is too irregular (which was the case if the viscosity ratio was insufficient), the beneficial effect of the additive particles was lost.

Roller action described in the literature could not be repeated with the additive polymer according to the invention. Microscopic evaluations of fiber cross sections and longitudinal sections suggest that the spinning traction tension is transferred to the forming additive polymer fibrils, and the polymer matrix undergoes distortion with low tension. This results in deformation of the matrix under conditions that result in a reduction of orientation and suppression of spinning induced crystallization. It is useful to evaluate the effect on spinning filament formation and processing behavior.

Furthermore, a additive polymer flow activation energy of at least 80 kJ/mol is preferred to achieve the beneficial effects of additive polymers according to the invention; that is a higher flow activation energy than that of the matrix polymers. Under such circumstances the additive polymer fibrils solidify before the matrix polymers and absorb a considerable portion of the applied spinning tension. As a result, it is possible to achieve the desired increase in capacity of the spinning installation.

A preferred embodiment of the invention described above is similarly suitable for the rapid spinning of POY filaments having a POY filament titer of =3–20 dtex, as well as of POY filament titers <3 dtex, in particular microfilaments with 0.2–2.0 dtex.

Due to the additive polymer, the filament rupture rate of fibers made according to the invention is considerably decreased compared to known methods. Advantageously, POYs produced according to the invention having a titer >3 dtex have a filament rupture rate that is less than 0.75 ruptures per ton of polymer mixture, preferably less than 0.5 ruptures/per ton of polymer mixture, and more preferably less than 0.4 ruptures per ton of polymer mixture.

Synthetic filaments obtained by the method of the invention can be used directly, or they can be further processed in art recognized manners. They are particularly advantageously used for the manufacture of staple fibers. In this context, reference is made, for example, to Patent DE 199 37 727 and the documents cited therein, for further detail on the manufacture of staple fibers of the state of the art.

Advantageously, POYs manufactured by the method according to the invention can be stretched or stretch textured. In this context, the following observations are important for the further processing of the spinning filament in the stretch texturing process at high speeds: spun filaments according to the invention, as preliminary yarn for stretch texturing—usually called POY—are preferably manufactured with draw-off speeds ≧2500 m/min, preferably >3500 m/min, more preferably >4000 m/min. These yarns must have a physical structure that is characterized by a specific degree of orientation and a low crystallization. The following parameters have been shown to be useful for their characterization: elongation at break, birefringence, crystallization, and shrinkage after boiling. The polymer mixture according to the invention is characterized by an elongation at break of the polymer spun filaments (POY) of at least 85% and at most 180%. The shrinkage after boiling is 32–69%, the birefringence is between 0.030 and 0.075, the crystallinity is less than 20%, and the rupture strength at least 17 cN/tex. It is preferred that the elongation at break of the polymer spun filaments be 85–160%. Particularly advantageous conditions exist if the elongation at break of the polymer spun filaments is between 109 and 146%, and, at the same time, the rupture strength is at least 22 cN/tex and the uster value is at most 0.7%.

Synthetic POYs obtained in this manner are particularly suitable for further processing in a stretching process or stretch texturing process. One also observes a lower number of filament ruptures during the further processing. The stretch texturing is carried out speeds dependent upon the filament titer type. For normal titer filaments ≧2 dtex per filament (final titer), speeds of ≧750 m/min and preferably ≧900 m/min are used. For microfilaments and fine titers (final titer) <2 dtex, speeds of 400–750 m/min are preferred. The method can be used advantageously for these titers and in particular for microfilaments with 0.15–1.10 dtex (final titer) per filament.

The stretch ratios to be used for the specified spun filaments are 1.35–2.2, where it is preferred to use stretch ratios in the upper portion of the range for lower degrees of orientation, and vice versa. In stretch texturing, the stretch ratio is influenced by tension surging as a function of the speed of operation. Therefore, it is particularly preferred to use stretch ratios according to the formula:

$$\text{Stretch ratio}=5\times10^{-4}\cdot w+b$$

where $w$=stretch texturing speed in m/min $b$=constant, between 1.15 and 1.50.

The invention is further explained below by means of an example and comparative example, although the inventive method is not limited to this example.

EXAMPLES

The indicated property values, as well as the values indicated above, were determined as follows:

The residual monomer content of methyl methacrylate and styrene was measured by gas chromatographic head space analysis, a method for the determination of volatile components in fluids and solids (including monomers in thermoplastics). The residual monomer content of N-cyclohexylmaleinimide was determined by gas chromatography of a solution of the polymer in dichloromethane.

The mean particle diameter of the spray dried flowability promoting adjuvant was determined by laser bending spectroscopy using a Mastersizer Microplus from the company Malvem (measurement range: 0.05–555 $\mu$m).

The mean particle diameter of the spun filament additive beads was determined by sieve analysis using an Alpine air jet sieving machine (type A 200 LS).

The intrinsic viscosity was determined using a solution of 0.5 g polyester in 100 mL of a mixture made of phenol and 1,2-dichlorobenzene (3:2 parts by weight) at 25° C.

The viscosity value VZ (also called Staudinger function) is the concentration-related relative change in viscosity of a 0.5% solution of copolymer in chloroform with reference to the solvent, where the passage times were determined in the Ubbelohde viscosimeter with suspended ball level, Schott type No. 53203 and capillaries 0c according to the DIN standard 51562 at 25° C. Chloroform was used as solvent.

$$VZ=\left(\frac{t}{t_0}-1\right)\cdot\frac{1}{c}$$

where t=passage time of the polymer solution in seconds $t_0$=passage time of the solvent in seconds c=concentration in g/100 $cm^3$ For the determination of the melt viscosity (initial viscosity), the polymer was dried in a vacuum to a water content ≦1000 ppm (polyester ≦50 ppm). The polymer was then introduced into a cone plate rheometer, type UM100, Physica Meβtechnik GmbH, Stuttgart/DE, using a nitrogen cloud on a temperature regulated measurement plate. In this process, the measurement cone (MK210) was positioned after the melting of the sample (approximately after 30 sec) onto the measurement plate. The measurement was started after an additional heating period of 60 sec (measurement time=0 sec). The measurement temperature was 290° C. for polyethylene terephthalate and additive polymers added to the polyethylene terephthalates, or it was equal to the melting temperature (method, see below) of the polymer in question plus 34.0° C. The measurement temperature so established corresponds to the typical processing or spinning temperature of the polymer in question. The sample quantity was chosen in such a manner that the rheometer gap was completely filled. The measurement was carried out at an oscillation a frequency of 2.4 Hz (corresponding to a shearing rate of 15 $sec^{-1}$) and a deformation amplitude of 0.3. The complex viscosity as a function of measurement time was determined. The initial viscosity was then calculated by linear regression to the measurement time zero.

For determination of the melting temperature of the polymer, the polymer sample was first melted at 310° C. for 1 min. and then immediately quenched to room temperature. The melting temperature was determined by DSC (differential scanning calorimetry) using a heating rate of 10° C./min. The preliminary treatment and measurement were carried out under a nitrogen.

The titer was determined in a known manner using a precision reel and a weighing device. The preliminary tension for preoriented filaments (POYs) was 0.05 cN/dtex and 0.2 cN/dtex for draw textured yarn (DTY).

The rupture strength and elongation at break were determined in a Statimat measurement apparatus under the following conditions: the clamping length was 200 mm for POY and 500 mm for DTY, the measurement speed was 2000 mm/min for POY and 1500 mm/min for DTY, and the preliminary tension was 0.05 cN/dtex for POY and 0.2 cN/dtex for DTY. By dividing the values for the maximum rupture load by the titer, the rupture strength was determined and the elongation at break was evaluated under a maximum load.

Example 1

Comparative Example

Polyethylene terephthalate flakes having a water content of less than 35 ppm, a limit viscosity value of 0.64 dL/g, and a melt viscosity (at 290° C.) of 250 Pas were introduced into the inlet of an extruder. A drop pipe was located vertically with respect to the direction of conveyance of the extruder worm and in a centered position with respect to the extruder inlet by means of which the additive, which had been dried to a residual humidity of <0.1 wt %, was added to the polyester flakes into the inlet area above the extruder worm with a gravimetric metering system.

As additive, a bead polymer based on MMA/styrene/N-cyclohexylmaleinimide and prepared in a suspension was used. The terpolymer used consisted of 89.2 wt % methyl methacrylate, 8.8 wt % styrene and 2 wt % N-cyclohexylmaleinimide, had a viscosity value VZ of approximately 101 $cm^3$/g and a melt viscosity (at 290° C.) of approximately 1400 Pas.

The MMA/styrene/N-cyclohexylmaleinimide additive with VZ 101 $cm^3$/g was obtained as follows:

a mixture consisting of 525 kg of completely desalted water, 0.071 kg of $KHSO_4$, and 13 g of a 13% aqueous solution of a polyacrylic acid was heated to 40° C. in a 1000-L polymerization vessel with heating/cooling jacket equipped with stirrer, reflux cooler, and thermometer. Under stirring, 525 kg of a mixture of 88.68 parts by weight of methyl methacrylate (MMA), 8.75 parts by weight of styrene, 1.99 parts by weight of N-cyclohexylmaleinimide, 0.14 parts by weight of thioglycolic acid 2-hexylethyl ester, 0.09 part by weight of tert-dodecylmercaptan, 0.05 part by weight of stearic acid, and 0.3 part by weight of dilauroyl peroxide were added. The preparation was polymerized for 130 min at 80° C. and for 60 min at 98° C. and then cooled to room temperature. The polymer beads were removed by filtration, thoroughly washed with completely desalted water, and dried in a fluidized bed dryer at 80° C.

The dried polymer beads were then mixed with 0.1 part by weight of a spray dried MMA/styrene emulsion polymer and mixed for approximately 5 min in a fluidized bed dryer.

The MMA/styrene emulsion polymer used as antistatic agent or flowability promoting adjuvant was obtained as follows:

80 kg of completely desalted water, 0.016 kg of 75% sodium diisooctylsulfosuccinate and 0.056 kg of sodium peroxodisulfate were introduced into a 500-L polymerization vessel with heating/cooling jacket equipped with stirrer, reflux cooler and thermometer and heated to an internal temperature of 92° C. In a second reactor equipped with a stirrer, an emulsion of 182.4 kg of methyl methacrylate, 17.6 kg of styrene, 0.080 kg of thioglycolic acid 2-ethylhexyl ester in 120 kg of completely desalted water, which contained 0.8 kg of sodium diisooctylsulfosuccinate and 0.12 kg of sodium peroxodisulfate, was prepared at room temperature. This emulsion was added by metering into the polymerization vessel at a rate of 1.2 kg/min, which was maintained at a polymerization temperature of approximately 92° C. by heating or cooling. After the end of the addition by metering, the reactor content was heated for an additional 30 min at an internal temperature of 92° C.

The polymer dispersion obtained was then spray dried in a Niro company manufactured spray tower equipped with an atomization disk rotating at 15,000 rpm. The air added was at a temperature of 180–190° C.; the exiting air was at a temperature of 75–80° C. The dried MMA/styrene copolymer had a mean particle size of $d_{50}$=14 μm.

The VZ of the spray dried MMA/styrene copolymer was 97 $cm^3/g$.

The spray dried MMA/styrene copolymer was mixed, as already described, at a concentration of 0.1 wt % with the MMA/styrene/N-cyclohexylmaleinimide in a fluidized bed dryer at room temperature for 5 min.

This process resulted in the production of 510 kg of polymer beads with viscosity value according to DIN 7745 of 101 $cm^3/g$, a residual methyl methacrylate content of 0.47 wt %, and a mean particle diameter of 0.75 mm. The residual styrene content was below the detection limit of 0.05 wt %. The residual N-cyclohexylmaleinimide content was below the detection limit of 0.1 wt %.

The additive was added at a concentration of 0.77 wt % (with reference to the total quantity of the polymer mixture of polyester and additive) and drawn off through the spinning system supplied by the extruder. The total quantity of polymer mixture drawn off was determined by the number of spinning pumps of the spinning system described below in operation and the delivery of each spinning pump. When all the spinning pumps were operated, a total quantity of 304.5 kg/h of polymer mixture was drawn off by the spinning system, and the additive was added by gravimetric metering in a quantity of 2.34 kg/h into the extruder inlet.

The wave motion of the extruder worm at the extruder inlet resulted in a premixing of the additive beads with the polyester flakes. The polyester flakes and the additive beads were melted and mixed together in the extruder, which was an LTM-24D/E8 spinning extruder manufactured by Barmag AG, Remscheidt/DE. The first polymer mixture was drawn off at a temperature of 290° C. and a pressure of 180 bar, conveyed as a melt stream at 304.5 kg/h through the melt line, and subjected to filtration using a 20-μm filter cartridge.

The filtered first polymer mixture was introduced into a static mixer of the SMX type manufactured by Sulzer AG with an internal diameter of 52.5 mm and a length of 525 mm, where it was homogenized and dispersed to form a second polymer mixture.

This second polymer mixture was distributed by means of a product line to twelve spinning positions, where each position contained six spinning packets, and where the mean residence time of the second polymer mixture from the time of exiting from the static mixture to the entry into the spinning packet was five minutes. Each spinning unit contained a round nozzle with 34 holes having a diameter of 0.25 mm and a length of twice the diameter. The spinning unit contained a spinning filter unit above the nozzle plate consisting of a steel sand packing at a height of 30 mm with a particle size of 0.5–0.85 mm, as well as a mesh fabric of 40 μm and a non-woven steel filter having a pore diameter of 20 μm. The diameter of the spinning filter unit was 85 mm. The residence time of the melt in the filter unit was approximately 1.5 min. The heating of the spinning packet was set at 290° C. The surface of the spinning nozzle was 30 mm above the limit of the heating box. At the time of the passage of the melt mixture, the nozzle pressure established was 150 bar. The mean residence time of the polymer mixture of polyester and additive melt from the extruder outlet to the outlet from the spinning packet was approximately ten minutes.

The melt-fluid filaments extruded from the nozzle holes were cooled by means of blown air flowing horizontally with respect to the filament direction at a speed of 0.55 m/sec and at a temperature of 18° C. and bundled at a distance of 1250 mm from the nozzle plate in an oiling stone to form a yarn, which was coated with spinning preparation.

An S-shaped looped roller pair pulled off the filament at a speed of 5000 m/min, where the spinning traction ratio was set at 141.

Between the rollers, a fluidization nozzle that was closed during normal filament direction was installed, which applied a fluidization knot number of 13 knots/m to the filament at an air pressure of 4.5 bar. The inlet tension at the inlet of the fluidization nozzle was set at 0.16 g/den.

In each case, six filaments of one spinning position were spooled onto a spooler to form spool packets, where the spooling speed of 4985 m/min was chosen in such a manner that the filament tension was 0.1 g/den before the spooling. The preoriented (POY) filaments obtained were characterized by a titer of 126 den, an elongation at break of 116%, and a rupture strength of 2.4 g/den.

During the production period of seven days, the rupture rate during the operation of the spinning system was on average 0.75 rupture per ton of polymer mixture processed.

The POYs obtained were stretch textured at a speed of 900 m/min using a texturing machine of the type FK6 manufactured by Barmag AG/Germany. The stretch ratio was 1.77, and the heating temperatures 1 and 2 were 210 and 170° C., respectively. The average rupture rate was 21 ruptures per ton of textured yarn. The textured yarn had a titer of 74 den, a rupture strength of 4.5 g/den, an elongation at break of 18.3%, and was characterized by good dye-uptake homogeneity.

Example According to the Invention

The spinning system described in the comparative example was used again with the same passage and spinning conditions. In the example according to the invention, an additive was also used consisting of 89.2 wt % methyl methacrylate, 8.8 wt % styrene and 2 wt % N-cyclohexylmaleinimide, where the terpolymer had a viscosity value VZ of approximately 101 $cm^3/g$. In contrast to the comparative example above, MMA/styrene/N-cyclohexylmaleinimide additive was used that had been obtained by a multiple initiation as follows:

a mixture of 525 kg of completely desalted water, 0.071 kg of $KHSO_4$, and 13 kg of a 13% aqueous solution of a polyacrylic acid was heated to 40° C. in a 1000-L polymerization vessel with heating/cooling jacket equipped with stirrer, reflux cooler, and thermometer. Under stirring, 525 kg of a mixture of 88.68 parts by weight of methyl methacrylate (MMA), 8.75 parts by weight of styrene, 1.99 parts by weight of N-cyclohexylmaleinimide, 0.14 part by weight of thioglycolic acid 2-ethylhexyl ester, 0.09 part by weight of t-dodecylmercaptan, 0.05 part by weight of stearic acid, 0.2 part by weight of dilauroyl peroxide, and 0.1 part by weight of tert-amylperoxy-2-ethylhexanoate was then added. The preparation was polymerized for 115 min at 80° C. and for 60 min at 98° C. and then cooled to room temperature. The polymer beads were then removed by filtration, thoroughly washed with completely desalted water, and dried in a fluidized bed dryer at 80° C. The dried polymer beads were then mixed with 0.1 part by weight of a spray dried MMA/styrene emulsion polymer (whose synthesis was described above in the comparative example) and mixed for approximately five minutes in the fluidized bed dryer.

The product obtained consisted of 513 kg of polymer beads with a viscosity value according to DIN 7745 of 101 $cm^3/g$, a residual methyl methacrylate content of 0.22 wt %, and a mean particle diameter of 0.75 mm. The residual styrene content was below the detection limit of 0.05 wt %. The residual N-cyclohexylmaleinimide content was less than the detection limit of 0.1 wt %.

In comparison to the additive obtained in the comparative example, the additive from the example according to the invention had a considerably lower residual monomer content while having a similar bead size and treatment with MMA/styrene emulsion polymer in the fluidized bed dryer.

The additive was added in the amount of 0.77 wt % with reference to the total quantity of polymer mixture introduced into the spinning system, and the polymer mixture was spun analogously to the comparative example.

POY filaments were again produced during a production period of seven days, characterized by a titer of 126 den, an elongation at break of 117%, and a rupture strength of 2.4 g/den. The average rupture rate during operation of the spinning system here was 0.35 rupture per ton of polymer mixture processed.

The POYs were stretch textured analogously to the comparative example at a speed of 900 m/min. The average rupture rate was 18 ruptures per ton of textured yarn. The textured yarn, while having the same titer and the same rupture strength as the textured yarn obtained in the comparative example, had an elongation at break of 18.6% while having an equally good dye-uptake homogeneity.

We claim:

1. A method of manufacturing synthetic fibers from a melt mixture of fiber forming matrix polymers, the method comprising adding to the fiber forming matrix polymers 0.05–5 wt % of at least one amorphous additive polymer that is immiscible with the fiber forming matrix polymer, wherein the additive polymer is obtained by multiple initiation and the wt % is with reference to the total weight of fiber forming matrix polymer and the additive polymer, and melt spinning the mixture.

2. The method according to claim 1, wherein the additive polymer is obtained by radical initiated polymerization in the presence of a mixture comprising at least two initiators with differential half lives.

3. The method according to claim 1, wherein the additive polymer has a residual monomer content of less than 0.62 wt % with reference to the total weight of the additive polymer.

4. The method according to claim 1, wherein the additive polymer has a residual monomer content of less than 0.47 wt % with reference to the total weight of the additive polymer.

5. Method according to claim 1, wherein the fiber forming matrix polymer is one or more polyesters.

6. The method according to claim 5, wherein the fiber forming matrix polymer is polyethylene terephthalate (PET), polytrimethylene terephthalate (PTMT) and/or polybutylene terephthalate (PBT).

7. The method according to claim 1, wherein the additive polymer is one or more polymers obtained by the polymerization of monomers having the general formula I:

I

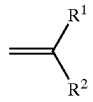

and wherein $R^1$ and $R^2$ are independently a substituent that consists of the optional atom C, H, O, S, P and halogen atom, where the total of the molecular weights of $R^1$ and $R^2$ is at least 40 dalton.

8. The method according to claim 7, wherein the additive polymer is polymethyl methacrylate and/or polystyrene.

9. The method according to claim 1, wherein the additive polymer is one or more polymers obtained by the copolymerization of 30–99 wt % E, 0–50 wt % F, 0–50 wt % G, and 0–50 wt % H, wherein E=monomers chosen from the group consisting of acrylic acid, methacrylic acid and $CH_2$=CR—COOR', where R is —H atom or —$CH_3$, and R' is $C_{1-15}$ alkyl, $C_{5-12}$ cycloalkyl, or $C_{6-14}$ aryl, F=monomers chosen from the group consisting of styrene and $C_{1-3}$ alkyl substituted styrenes, G=monomers, chosen from the group of compounds consisting of compounds having formula II, III and IV:

II

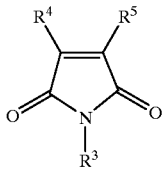

III

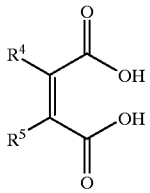

IV

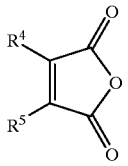

where $R^3$, $R^4$, and $R^5$ are independently —H, $C_{1-15}$ alkyl, $C_{5-12}$ cycloalkyl, or $C_{6-14}$ aryl, and H=one or more ethylenically unsaturated monomers optionally copolymerized with E, F, and/or G and selected from the group consisting of α-methylstyrene, vinyl acetate, acrylic acid esters and methacrylic acid esters differing from E, acrylonitrile, acrylamide, methacrylamide, vinyl chloride, vinylidene chloride, halogen substituted styrenes, vinyl ethers, isopropylene ethers, and dienes, where the total of E, F, G and H is 100% of the polymerizable monomers.

10. The method according to claim 9 wherein the additive polymer is a terpolymer of methyl methacrylate, styrene, and N-cyclohexylmaleinimide.

11. The method according to claim 1, further comprising stretch processing or stretch texturing processing of the synthetic fibers.

* * * * *